US011028640B2

(12) United States Patent
Anderson et al.

(10) Patent No.: US 11,028,640 B2
(45) **Date of Patent: *Jun. 8, 2021**

(54) HANDLE AND BRAKE ARRANGEMENT FOR A COVERING FOR ARCHITECTURAL OPENINGS

(71) Applicant: Hunter Douglas Inc., Pearl River, NY (US)

(72) Inventors: Richard N. Anderson, Whitesville, KY (US); Eugene W. Thompson, Maceo, KY (US); Robert E. Fisher, Owensboro, KY (US)

(73) Assignee: HUNTER DOUGLAS INC., Pearl River, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/556,416

(22) Filed: Aug. 30, 2019

(65) Prior Publication Data

US 2019/0383093 A1 Dec. 19, 2019

Related U.S. Application Data

(60) Continuation of application No. 15/210,105, filed on Jul. 14, 2016, now Pat. No. 10,407,981, which is a (Continued)

(51) Int. Cl.

| | |
|---|---|
| ***E06B 9/325*** | (2006.01) |
| ***E06B 9/322*** | (2006.01) |
| ***E06B 9/324*** | (2006.01) |
| ***E06B 9/90*** | (2006.01) |
| ***E06B 9/78*** | (2006.01) |
| ***E06B 9/80*** | (2006.01) |
| ***E06B 9/326*** | (2006.01) |
| *E06B 9/262* | (2006.01) |

(52) U.S. Cl.

CPC ..... *E06B 9/325* (2013.01); *E06B 9/322* (2013.01); *E06B 9/324* (2013.01); *E06B 9/326* (2013.01); *E06B 9/78* (2013.01); *E06B 9/80* (2013.01); *E06B 9/90* (2013.01); *E06B 2009/2625* (2013.01); *E06B 2009/3222* (2013.01); *Y10T 16/44* (2015.01)

(58) Field of Classification Search

CPC ..... E06B 9/326; E06B 9/322; E06B 9/324; E06B 9/44; E06B 9/78; E06B 9/80; E06B 9/90; E06B 2009/2625; E06B 2009/3222

See application file for complete search history.

(56) References Cited

U.S. PATENT DOCUMENTS

| | | | |
|---|---|---|---|
| 664,181 | A | 12/1900 | Shepard |
| 765,736 | A | 7/1904 | Keil |

(Continued)

FOREIGN PATENT DOCUMENTS

| | | |
|---|---|---|
| DE | 10216363 | 11/2003 |
| EP | 2740878 | 6/2014 |

(Continued)

*Primary Examiner* — Johnnie A. Shablack

(74) *Attorney, Agent, or Firm* — Dority & Manning, P.A.

(57) ABSTRACT

A handle is releasably secured to a rail wall by means of fasteners extending from inside the rail. An actuator shaft pushes against a contact plate to move a movable braking member to stop the rotation of a rod inside the rail.

20 Claims, 10 Drawing Sheets

Related U.S. Application Data division of application No. 14/326,616, filed on Jul. 9, 2014, now Pat. No. 9,422,766.

(60) Provisional application No. 61/873,035, filed on Sep. 3, 2013, provisional application No. 61/847,117, filed on Jul. 17, 2013.

(56) References Cited

U.S. PATENT DOCUMENTS 800,279 A 9/1905 Emery
1,775,657 A 9/1930 Ruprecht
1,892,097 A 12/1932 Stuber
2,095,397 A 10/1937 Overmyer
2,172,977 A 9/1939 Kimball
2,205,259 A 6/1940 Harbison
2,233,516 A 3/1941 Cecil
2,234,097 A 3/1941 Tinnerman
2,239,798 A 4/1941 Tinnerman
2,329,767 A 9/1943 Jakeway
2,486,557 A 11/1949 Flora
2,508,199 A 5/1950 Swartswelter
2,537,828 A 1/1951 Hoffman
2,542,038 A 2/1951 Lewis
2,608,712 A 9/1952 Seyforth
2,639,766 A 5/1953 Pratt
2,695,690 A 11/1954 Rees
2,761,721 A 9/1956 Jakeway
2,835,917 A 5/1958 Smythe
2,982,989 A 5/1961 Heyer
3,000,047 A 9/1961 Hill
3,007,348 A 11/1961 Barnes
3,075,735 A 1/1963 Skinner
3,470,764 A 10/1969 Frymire
3,935,787 A 2/1976 Fisher
3,995,349 A 12/1976 Roberts
4,525,894 A 7/1985 Knapp
4,593,737 A 6/1986 Clemente
4,807,686 A 2/1989 Schnebly
4,821,786 A 4/1989 Johnston
4,887,657 A 12/1989 Spohr
4,911,348 A 3/1990 Rasor
5,090,468 A 2/1992 Tedeschi
5,267,598 A 12/1993 Marocco
5,405,115 A 4/1995 Reed
5,647,422 A 7/1997 Weng
5,652,999 A 8/1997 Jarvis
5,727,858 A 3/1998 Shapiro
5,781,956 A 7/1998 Kelsay
5,797,164 A 8/1998 Donaghy
5,927,836 A * 7/1999 Herr ..... D06F 39/12 16/412
5,957,184 A 9/1999 Gross et al.
5,991,976 A 11/1999 Adams
6,024,154 A 2/2000 Wang et al.
6,029,734 A 2/2000 Wang et al.
6,439,626 B1 8/2002 Rohlfing
6,463,983 B1 10/2002 Lang
6,536,503 B1 3/2003 Anderson et al.
6,575,223 B1 6/2003 Chung et al.
6,644,372 B2 * 11/2003 Judkins ..... E06B 9/32 160/170
6,647,594 B1 11/2003 Deb
6,675,861 B2 1/2004 Palmer et al.
6,684,930 B2 2/2004 Palmer
6,823,925 B2 11/2004 Militello
6,826,804 B2 12/2004 Zaidman
6,932,140 B2 8/2005 Ni
7,093,644 B2 8/2006 Strand
7,096,917 B2 8/2006 Ciuca et al.
7,117,919 B2 * 10/2006 Judkins ..... E06B 9/32 160/170
7,159,635 B2 1/2007 Holt et al.
7,175,377 B2 2/2007 Womack
7,180,398 B2 2/2007 Hoffmann et al.
7,311,133 B2 12/2007 Anderson
7,311,134 B2 12/2007 Cheng
7,320,354 B2 1/2008 Cheng
7,331,370 B1 2/2008 Militello et al.
7,458,133 B2 12/2008 Wing
7,575,036 B2 8/2009 Cheng
7,624,893 B2 12/2009 Hoff
7,690,415 B2 4/2010 Cheng
7,740,045 B2 6/2010 Anderson et al.
7,913,738 B2 3/2011 Fraser et al.
7,967,345 B2 6/2011 Davies
D647,777 S * 11/2011 Franssen ..... D8/107
8,074,698 B2 12/2011 Allsopp
8,459,325 B2 6/2013 Faller
8,739,853 B2 * 6/2014 Judkins ..... E06B 9/322 160/170
8,770,257 B2 7/2014 Kao
8,794,296 B2 * 8/2014 Shih ..... E06B 9/388 160/168.1 R
8,887,786 B2 11/2014 Anderson et al.
8,944,135 B2 2/2015 Spray
9,078,537 B2 7/2015 Lee
9,157,274 B2 10/2015 Cheng
9,217,282 B2 12/2015 Defenbaugh et al.
9,314,125 B2 * 4/2016 Anthony ..... A47H 5/032
9,341,019 B2 * 5/2016 Chen ..... E06B 9/388
9,357,868 B2 6/2016 Anderson et al.
9,422,766 B2 * 8/2016 Anderson ..... E06B 9/90
9,445,684 B2 9/2016 Franssen
9,482,048 B2 * 11/2016 Anderson ..... E06B 9/262
9,677,330 B2 * 6/2017 Anderson ..... E06B 9/325
9,708,850 B2 * 7/2017 Anderson ..... E06B 9/262
9,976,796 B2 5/2018 Jang
10,138,674 B2 * 11/2018 Hsu ..... E06B 9/322
10,407,981 B2 * 9/2019 Anderson ..... E06B 9/80
10,557,304 B2 * 2/2020 Anderson ..... E06B 9/322
2002/0088562 A1 7/2002 Palmer
2002/0174961 A1 11/2002 Anderson
2004/0250965 A1 12/2004 Strand
2005/0205219 A1 9/2005 Hsu
2006/0118248 A1 6/2006 Anderson et al.
2006/0196612 A1 * 9/2006 Strand ..... E06B 9/388 160/84.05
2007/0023151 A1 2/2007 Judkins
2007/0051477 A1 3/2007 Fraser et al.
2007/0084567 A1 4/2007 Chen
2007/0107854 A1 5/2007 Jelic
2007/0151676 A1 7/2007 Lin
2008/0000592 A1 1/2008 Huang
2008/0093034 A1 4/2008 Anderson
2008/0115984 A1 5/2008 Cech
2008/0277075 A1 * 11/2008 Cheng ..... E06B 9/322 160/167 R
2008/0277076 A1 * 11/2008 Cheng ..... E06B 9/322 160/167 R
2010/0206492 A1 8/2010 Shevick
2011/0179603 A1 * 7/2011 Edelen ..... A47B 95/02 16/415
2011/0289730 A1 * 12/2011 Gerdes ..... E05B 81/78 16/412
2012/0227912 A1 9/2012 Anderson
2013/0032300 A1 2/2013 Yu et al.
2013/0340949 A1 12/2013 Anderson et al.
2014/0048220 A1 * 2/2014 Cheng ..... E06B 9/24 160/368.1
2014/0076504 A1 3/2014 Anthony et al.
2014/0158314 A1 6/2014 Anderson et al.
2015/0013921 A1 * 1/2015 Franssen ..... E06B 9/322 160/84.04
2015/0020982 A1 1/2015 Anderson et al.
2015/0028144 A1 1/2015 Defenbaugh et al.
2015/0034262 A1 2/2015 Franssen
2015/0075729 A1 3/2015 Anderson et al.
2015/0197984 A1 7/2015 Anderson et al.
2015/0211293 A1 7/2015 Anderson et al.
2016/0010389 A1 1/2016 Anderson et al.
2016/0017656 A1 1/2016 Adreon
2016/0222722 A1 8/2016 Schulman

(56) References Cited

U.S. PATENT DOCUMENTS

| | | | | |
|---|---|---|---|---|
| 2016/0251896 | A1 | 9/2016 | Anderson | |
| 2016/0319594 | A1* | 11/2016 | Anderson | E06B 9/322 |
| 2017/0044822 | A1 | 2/2017 | Anderson | |
| 2017/0211316 | A1 | 7/2017 | Strand | |
| 2017/0211322 | A1 | 7/2017 | Smith | |
| 2017/0218695 | A1 | 8/2017 | Hsu | |
| 2017/0226794 | A1 | 8/2017 | Huang | |
| 2017/0234062 | A1 | 8/2017 | Schwandt | |
| 2017/0234063 | A1* | 8/2017 | Schwandt | E05B 1/0015 160/368.1 |
| 2017/0314325 | A1 | 11/2017 | Anderson | |
| 2019/0383093 | A1* | 12/2019 | Anderson | E06B 9/78 |

FOREIGN PATENT DOCUMENTS

| | | | | |
|---|---|---|---|---|
| EP | 2826944 | | 1/2015 | |
| WO | WO 2012/154871 | | 11/2012 | |
| WO | WO-2012154871 | A1 * | 11/2012 | E06B 9/262 |
| WO | WO 2013/129918 | | 9/2013 | |

* cited by examiner

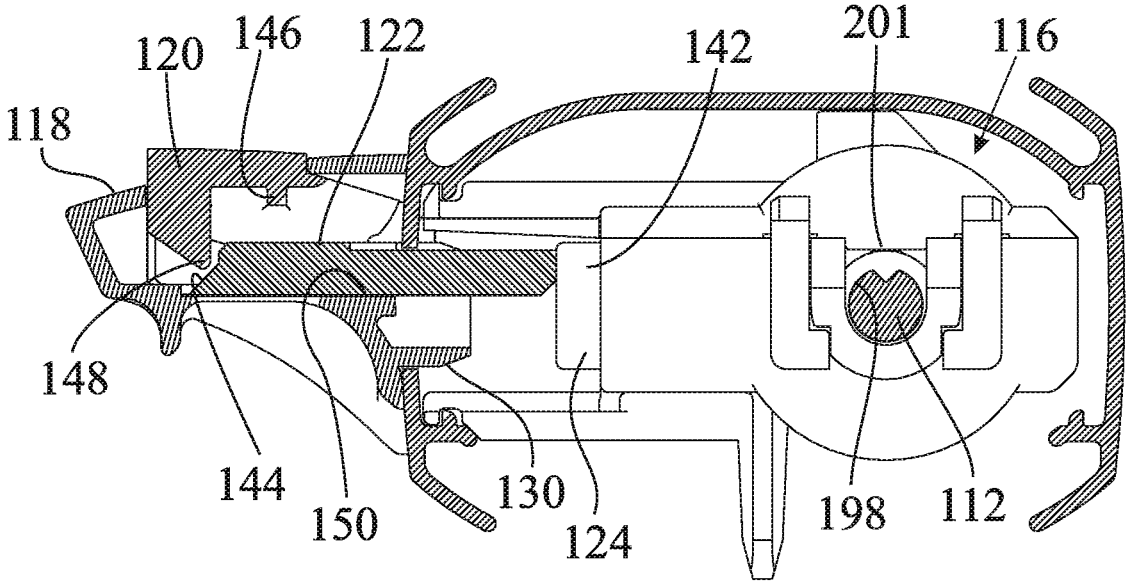
FIG 5
FIG 6
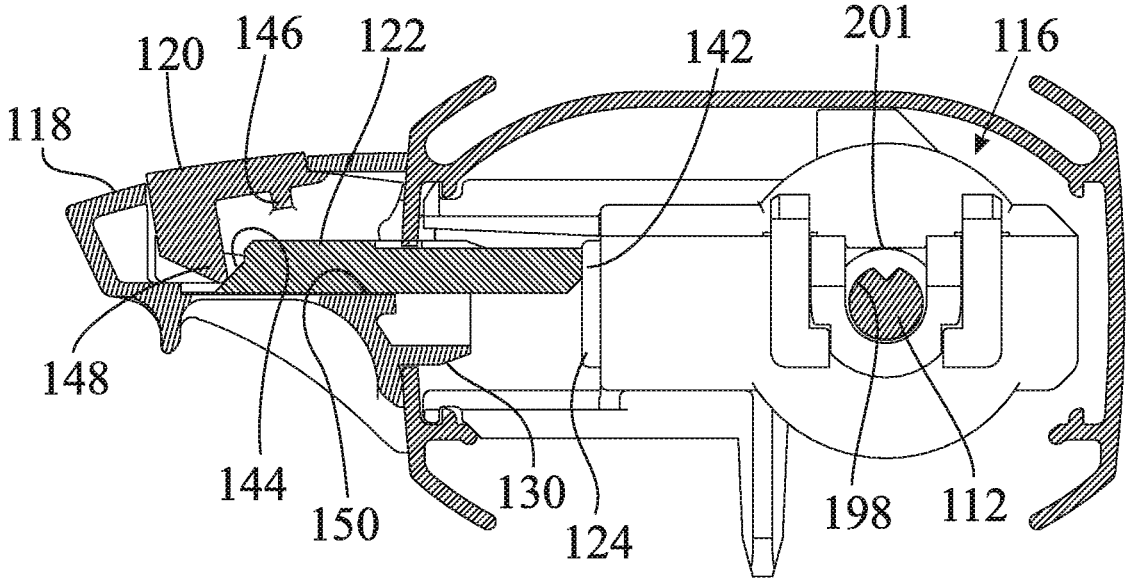

HANDLE AND BRAKE ARRANGEMENT FOR A COVERING FOR ARCHITECTURAL OPENINGS

CROSS-REFERENCE TO RELATED APPLICATIONS

This patent application is a continuation of and claims the benefit of priority to U.S. patent application Ser. No. 15/210,105, filed Jul. 14, 2016, which is a divisional of and claims the benefit of priority to U.S. patent application Ser. No. 14/326,616, filed Jul. 9, 2014, now U.S. Pat. No. 9,422,766, which in turn claims the benefit of priority to U.S. patent application Ser. No. 61/847,117, filed Jul. 17, 2013 and U.S. patent application Ser. No. 61/873,035, filed Sep. 3, 2013. Each of the foregoing patent applications is hereby incorporated by reference herein in its entirety for all purposes.

BACKGROUND

The present invention relates to a handle and brake arrangement for a covering for architectural openings.

In typical prior art arrangements, a handle may be attached to a rail by snapping the handle into a complementary contour on the rail or by using bolts, screws or other threaded fasteners. The snap-on method often is not secure and may be aesthetically objectionable. The threaded fasteners can fail due to stripped threads, can be unsightly, or may involve the use of additional parts and labor in order to conceal the fastener.

SUMMARY

The present invention provides a simple, secure, inexpensive, hidden, and relatively tamper-proof connection arrangement for securing the handle to the rail. In one embodiment the handle is secured to the rail via screws, using a skewed approach angle. The handle may be used not only to grasp the rail, but it also may provide a convenient mechanism to engage or disengage a brake in the rail.

BRIEF DESCRIPTION OF THE DRAWINGS

FIG. 5 is a section view along line 5-5 of FIG. 1, with the cellular shade product omitted for clarity;

FIG. 6 is a section view, similar to FIG. 5, but with the brake release mechanism depressed to release the brake;

DESCRIPTION

Figure 1:
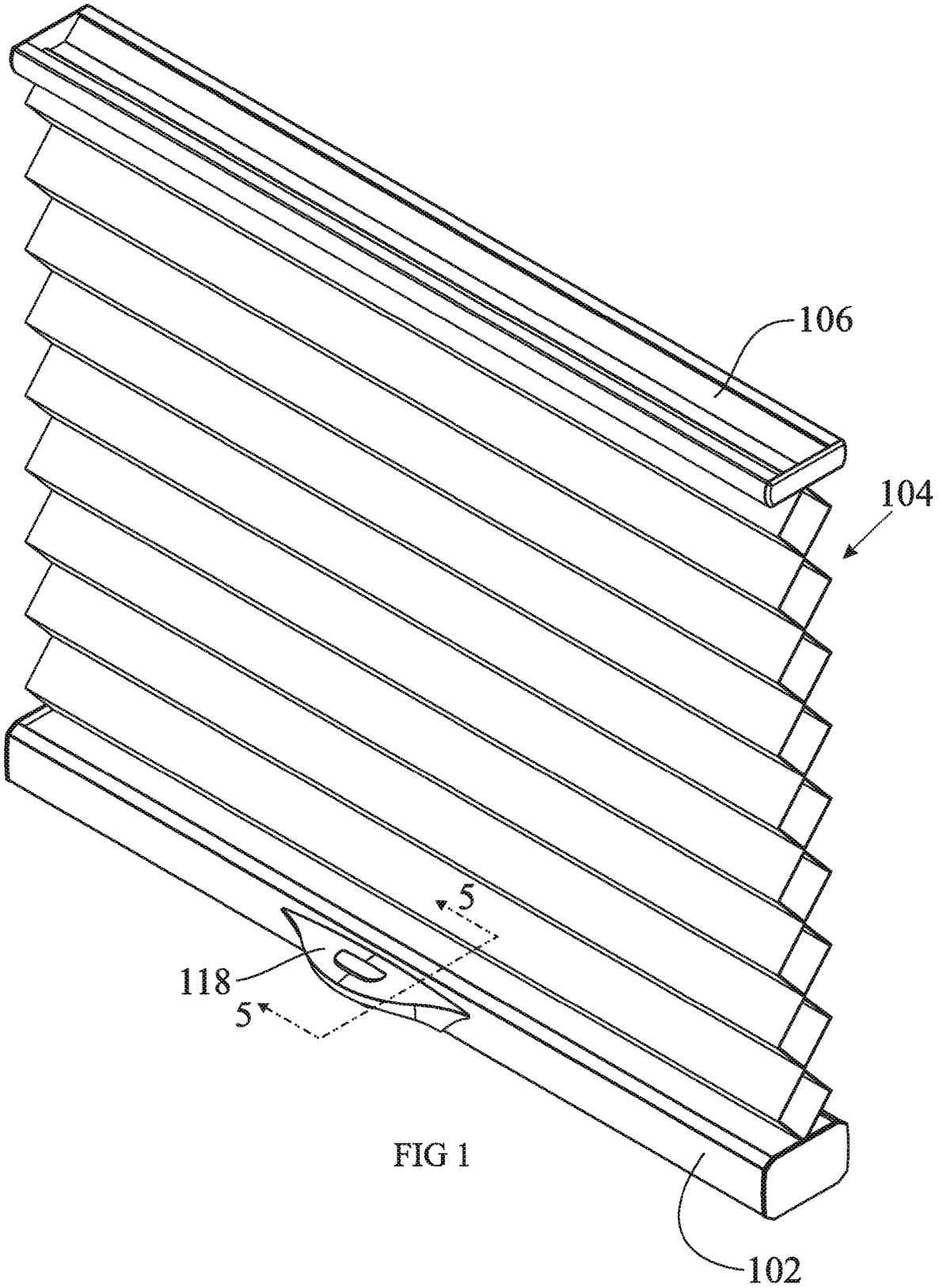
FIG. 1 is a perspective view of a cellular shade product with a handle secured to the movable rail.

FIG. 1 is a perspective view of a cellular shade 104, having an upper rail 106, a movable lower rail 102, and a handle 118 mounted on the lower rail 102. As will be explained later, the handle 118 also may be mounted on the upper rail 106 or on any intermediate movable rails (not shown).

Figure 2:
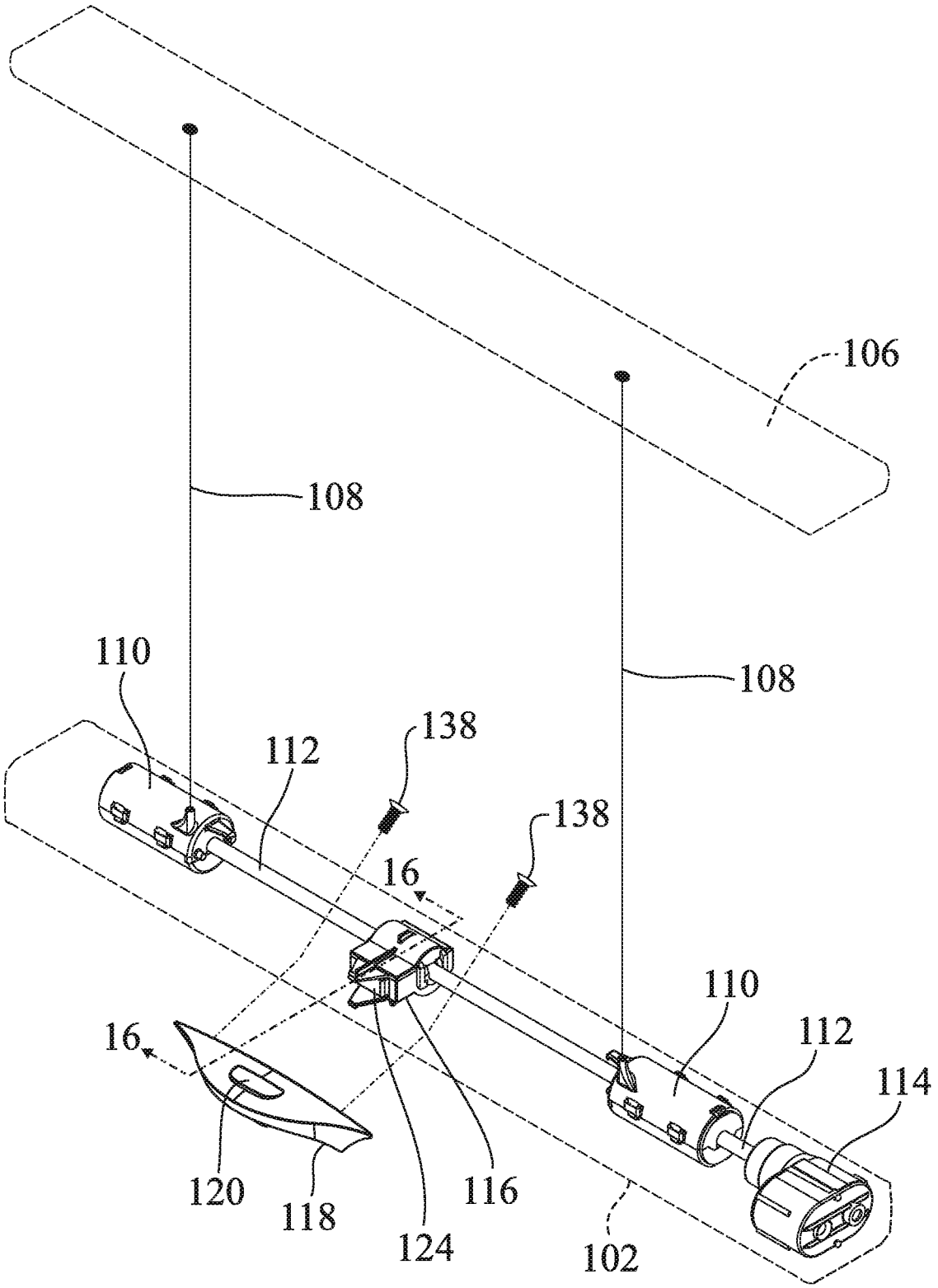
FIG. 2 is a schematic, partially exploded, perspective view of the drive mechanism of FIG. 1 including the handle.
Figure 4:
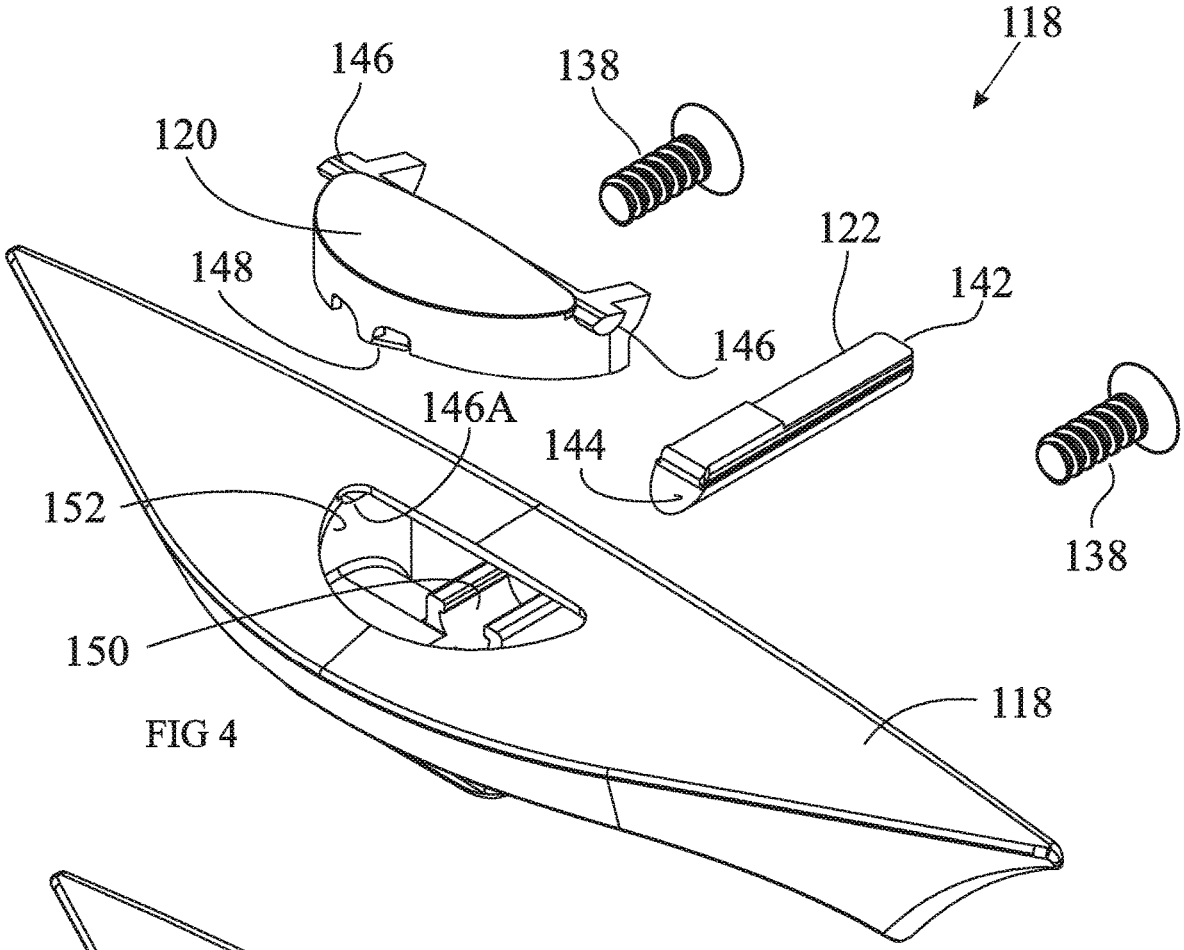
FIG. 4 is an exploded perspective view of the handle of FIG. 3.
Figure 3:
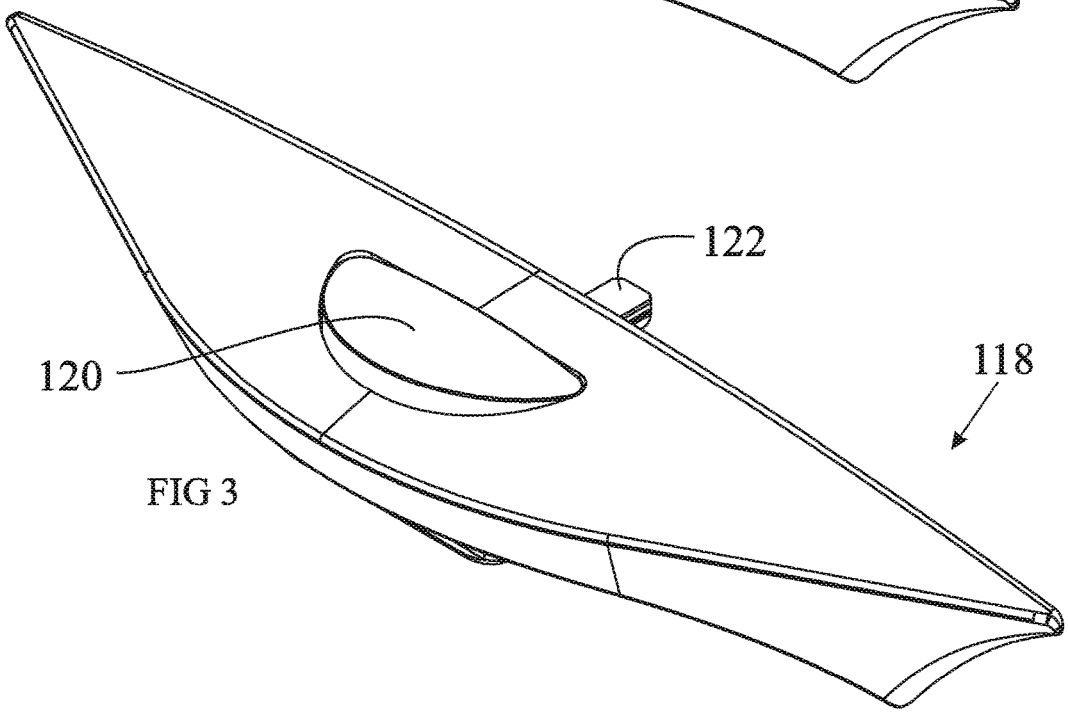
FIG. 3 is a perspective view of the handle of FIGS. 1 and 2.

FIG. 2 is a schematic showing the rails 102, 106 in phantom, with the cellular shade itself omitted for clarity. The lower rail 102 is suspended from the upper rail 106 by means of left and right lift cords 108 which wind onto lift spools (not shown) in lift stations 110 (when raising the shade 104), or unwind from the spools of the lift stations 110 (when lowering the shade 104). The lift stations 110 are functionally interconnected by a lift rod 112 such that the lift rod 112 and lift spools of the lift stations 110 rotate in unison. The lift rod 112 extends through the rightmost lift station 110 and is connected to a spring motor 114 which provides a force to aid the user in lifting the shade 104. As the rod 112 rotates in one direction about its axis of rotation, the lift cords 108 wind up onto the lift spools of the lift stations 110 to retract the shade, and as the rod 112 rotates in the opposite direction, the lift cords 108 unwind from the lift spools and extend the shade or covering 104.

In this embodiment, the spring motor 114 is underpowered such that it is unable to raise the shade 104 alone and needs additional input (referred to as a catalytic force) from the user to accomplish that task. This particular spring motor 114 also is unable to hold the bottom rail 102 in place once it is released by the user. The weight of the bottom rail 102 (together with the components found in the bottom rail 102 and the weight of the shade material) overwhelms the force provided by the spring motor 114 such that the bottom rail 102 will continue to drop once released by the user unless it is stopped by other means. To stop the bottom rail from dropping, a brake 116 is functionally connected to the lift rod 112 and to the bottom rail 102 to stop the lift rod 112 from rotating in at least one direction relative to the bottom rail 102, as explained in more detail later.

The handle 118 includes an actuator button 120 which, when depressed by the user, releases the brake 116, which allows rotation of the lift rod 112 in both clockwise and counterclockwise directions, as explained in more detail later.

The brake 116 can be mounted anywhere along the lift rod 112 and does not have to be precisely located relative to the handle 118 in order for the actuator button 120 to function to release the brake 116. This is advantageous, as it permits the handle to be secured to the rail 102 from inside the rail with the brake 116 out of the way, and then permits the brake 116 to be slid along the lift rod 112 into a position that is generally opposite the handle 118, without having to worry about the precise location of the brake 116.

Figure 7:
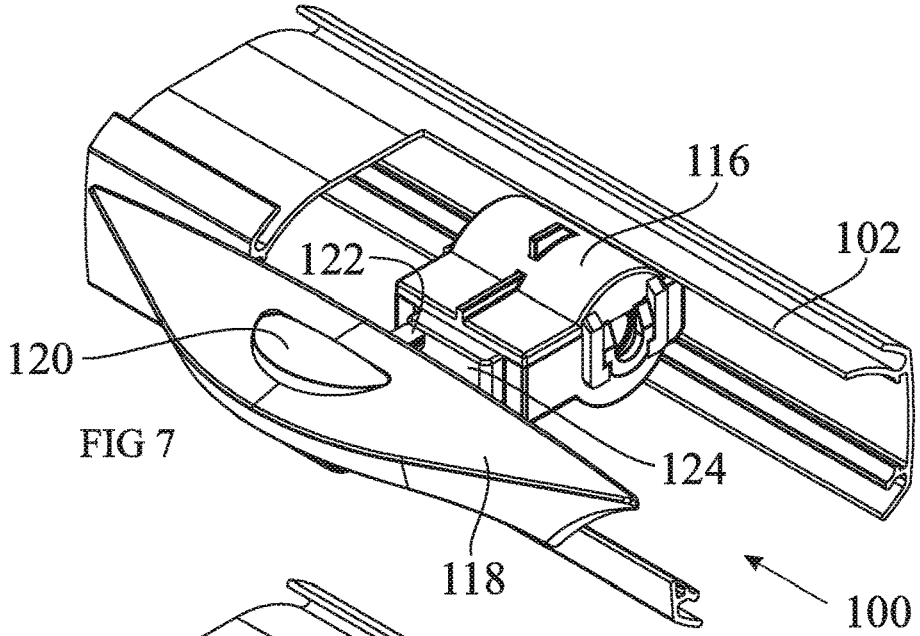
FIGS. 7-9 show the handle and brake mechanism of FIG. 5 with the lift rod omitted for clarity, and with the brake portion in three different axial positions relative to the handle portion to illustrate that the brake portion does not have to be precisely located in order for the pusher to actuate the brake release mechanism.
Figure 8:
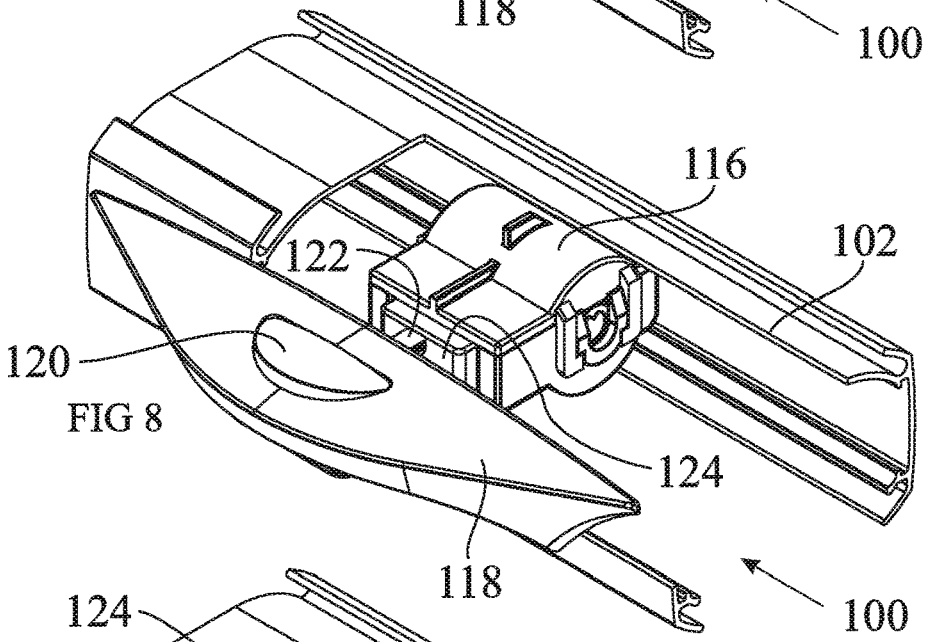
Figure 9:
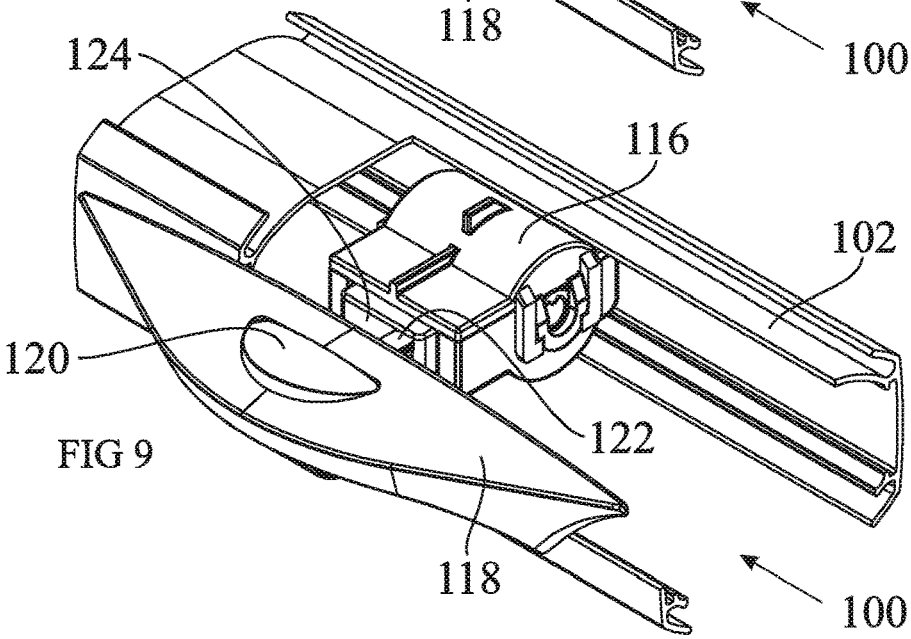

As shown in FIGS. 7-9, the brake 116 may be anywhere along the axial length of the rail 102 as long as it is aligned approximately in the vicinity of the pusher 122, which in this embodiment is a shaft. As long as the pusher 122 abuts the contact plate 124 of the brake 116, the handle and brake combination 100 will operate as designed.

Figure 11:
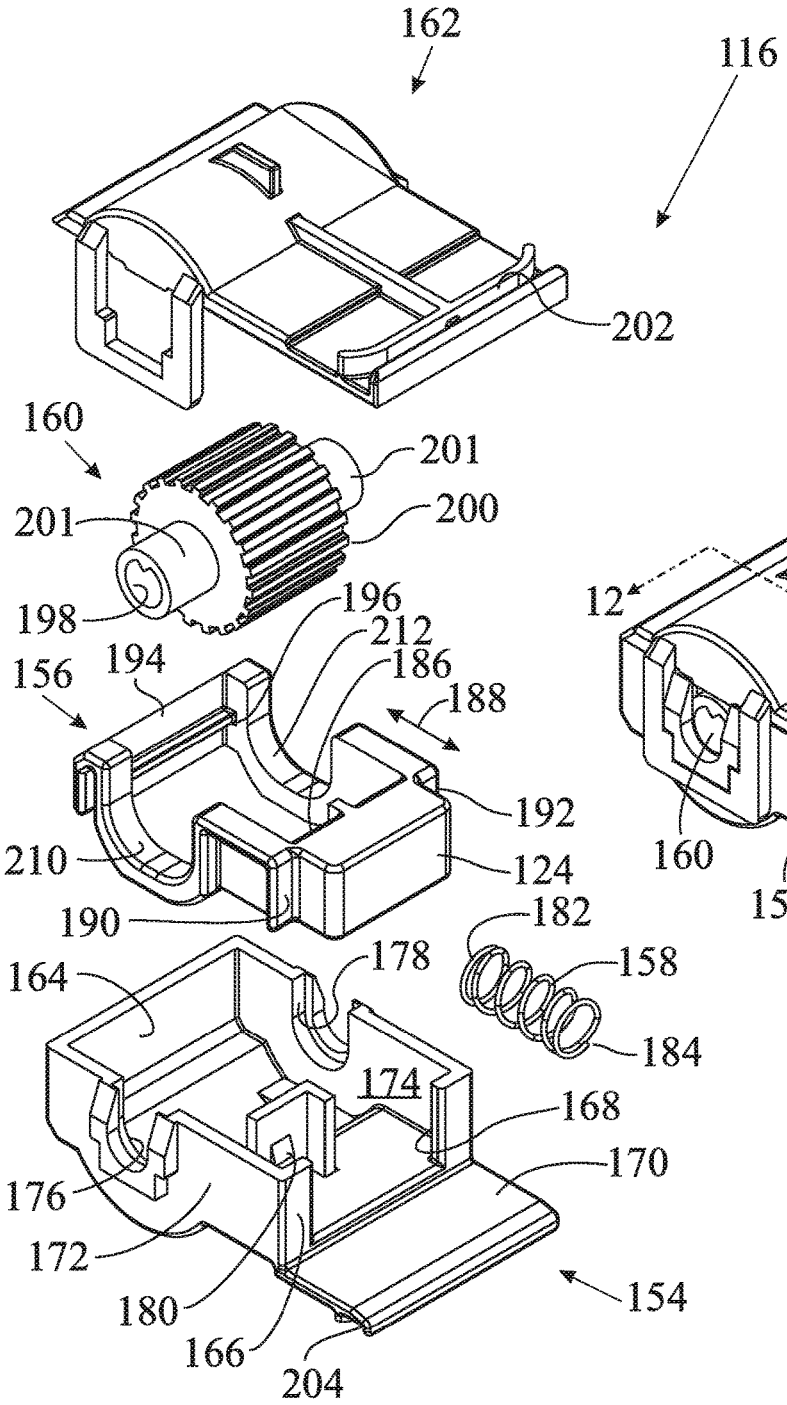
FIG. 11 is an exploded perspective view of the brake portion of FIG. 10.
Figure 10:
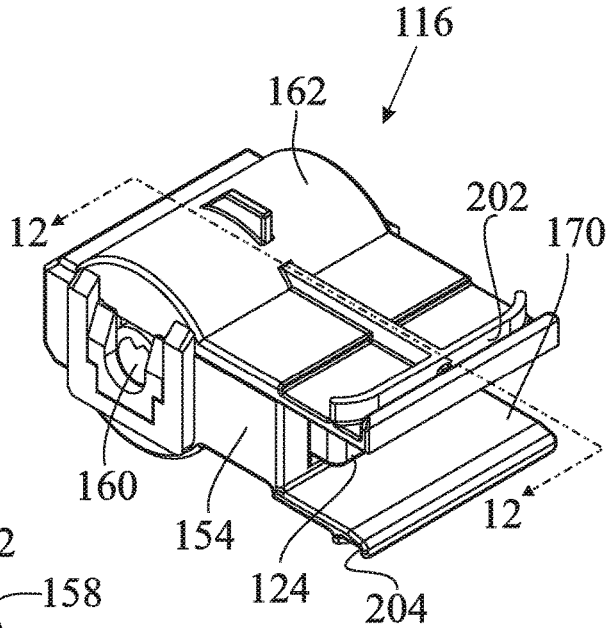
FIG. 10 is a perspective view of the brake portion of the brake and handle mechanism of FIG. 7.

FIG. 11 shows the details of the brake 116. The brake 116 includes a housing base 154, a slide element 156, a coil spring 158, a splined sleeve 160 and a housing cover 162. The housing base 154 is a substantially rectangular box having a flat back wall 164, a flat front wall 166 which defines a large central opening 168, and a forwardly extending fixed tab 170 secured to the front wall 166 for mounting the housing base 154 on the rail 102. The housing base 154 includes side walls 172, 174, which define aligned, openings 176, 178 which rotationally support the splined sleeve 160. The housing base 154 also defines an internal projection 180 designed to receive and engage one end 182 of the coil spring 158. The other end 184 of the coil spring 158 is received in a partitioned cavity 186 on the slide element 156, in order to bias the slide element 156 in the forward (braking) direction, which is transverse to the axis of rotation of the lift rod 112, as will be described in more detail later.

The slide element 156 has a contact plate 124, which is pushed against by the actuator in the handle 118, in a direction opposite to the braking direction, in order to disengage the brake. The slide element 156 is received in the housing base 154, with the contact plate 124 of the slide element 156 projecting through the opening 168 in the housing 154. The slide element 156 is guided by the housing base 154 so its movement is restricted to forward and backward movement in the direction of the arrow 188 relative to the housing base 154. Shoulders 190, 192 on the slide element 156 limit the movement of the slide element 156 in the forward direction as they impact the front wall 166 of the housing 154. As indicated above, the coil spring 158 biases the slide element 156 in the forward direction (which as explained later, is the braked position). The rear wall 194 of the slide element 156 defines a left-to-right directed ridge 196, which extends parallel to the front and rear walls 124, 194 of the slide element 156 and parallel to the lift rod 112.

The splined sleeve 160 is a generally cylindrical body defining a hollow through shaft 198 having a non-circular profile. In this particular embodiment, it has a "V" projection profile. The lift rod 112 (See FIG. 2) has a complementary "V" notch. The lift rod 112 is sized to match the internal profile of the hollow through shaft 198, with the "V" projection of the hollow through shaft 198 being received in the "V" notch of the lift rod 112, such that the splined sleeve 160 and the lift rod 112 are positively engaged to rotate together. Thus, when the splined sleeve 160 is prevented from rotation, the lift rod 112 is likewise prevented from rotation.

The splined sleeve 160 also defines a plurality of radially extending splines 200. The ends of the splined sleeve 160 define smooth stub shafts 201 which are rotationally supported on the "U"-shaped surfaces 176, 178 of the housing base 154. The slide element 156 has recessed arms 210, 212, which permit the slide element 156 to move forwardly and backwardly within the housing base 154 without interfering with the stub shafts 201.

Figure 12:
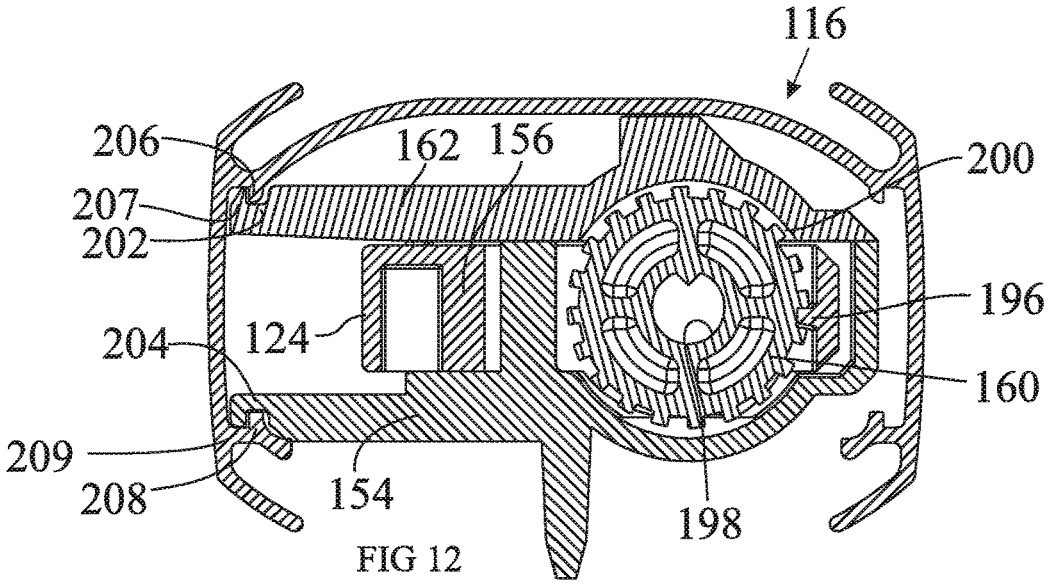
FIG. 12 is a section view along line 12-12 of FIG. 10.

As shown in FIG. 12, when the slide element 156 is pushed forward by the biasing spring 158, which is its normal, braked position, the ridge 196 on the rear wall 194 of the slide element 156 is received between two of the splines 200 of the splined sleeve 160, which prevents rotation of the splined sleeve 160 and of the lift rod 112 (and of the lift drums in the lift stations 110), thereby preventing the movable rail 102 from being raised or lowered.

When the slide element 156 is pushed rearwardly by pushing against the contact plate 124, the ridge 196 moves out of engagement with the splined sleeve 160, allowing the splined sleeve 160, the lift rod 112, and the lift drums to rotate in order to raise or lower the movable rail 102.

A housing cover 162 snaps onto the housing base 154 to substantially enclose the slide element 156 and the coil spring 158 within the brake 116. As shown in FIG. 12, a channel 202 on the housing cover 162 and a corresponding channel 204 on the housing base 154 receive corresponding lips 206, 208 on the rail 102, and ribs 207, 209 on the housing cover 162 and housing base 154 engage the lips 206, 208 on the rail 102 (See FIG. 12) to mount the brake 116 onto the rail 102. This mounting arrangement for the cover 162 and base 154 of the brake 116 firmly secures the body of the brake 116 to the front wall 13 of the rail 102 while allowing the brake 116 to slide in the longitudinal direction along the rail 102.

Alternate Embodiments of the Brake

Figure 13:
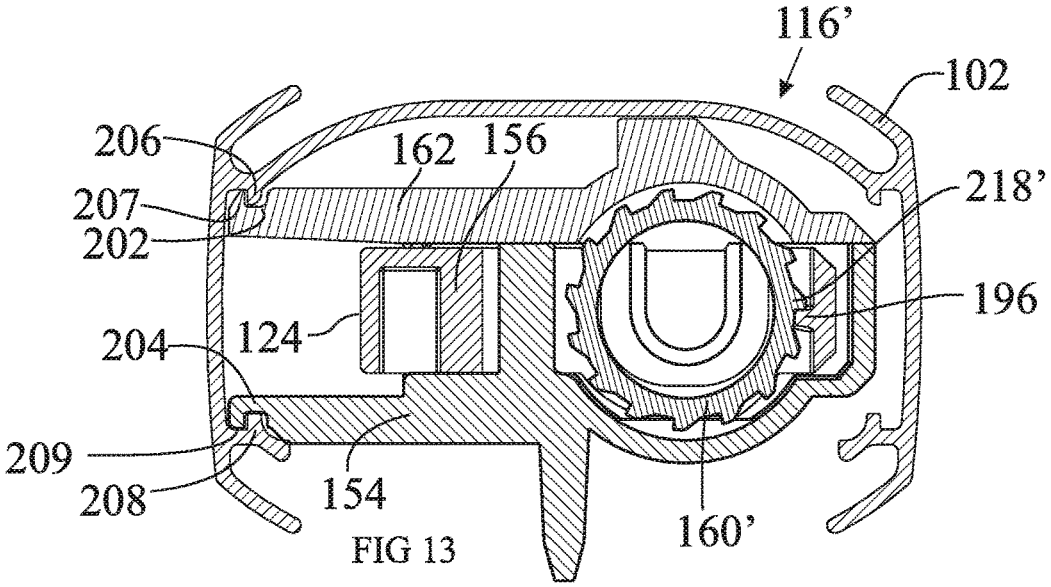
FIG. 13 is a section view, similar to FIG. 12, but for a different embodiment showing a ratchet-type brake mechanism.

FIG. 13 shows an alternate embodiment of a brake 116' wherein the splined sleeve 160 is replaced with a ratchet sleeve 160'. The ratchet sleeve 160' has angled ratchet teeth 218', and the ridge 196 acts as the pawl. Due to the shape of the ratchet teeth 218', the ratchet sleeve 160' can freely rotate in the counterclockwise direction as shown in FIG. 13, with the ridge 196 sliding along the tapered edge of each tooth and pushing the slide element 156 backward so the tooth can pass by the ridge 196. However, in the clockwise direction, the ratchet sleeve 160' acts in the same manner as the splined sleeve 160 of the previous embodiment, with the ridge 196 abutting the ratchet tooth 218' and stopping rotation of the ratchet sleeve 160', the lift rod 112, and the lift drums.

This embodiment 116' has the advantage that the brake 116' need not be disengaged (unlocked) for rotation of the splined sleeve 160' (and therefore rotation of the lift rod 112) in the counterclockwise direction (as seen from the vantage point of FIG. 13). In a preferred application this arrangement is configured so that disengagement (unlocking) of the brake 116' is only needed for lowering the shade 104 (See FIG. 1). The shade 104 may be raised by simply pushing up on the rail 102 and allowing the motor 114 to rotate the lift drums to wind up the lift cords 108, without first having to release the brake 116' by pushing down on the button 120 of the handle 118.

Figure 14:
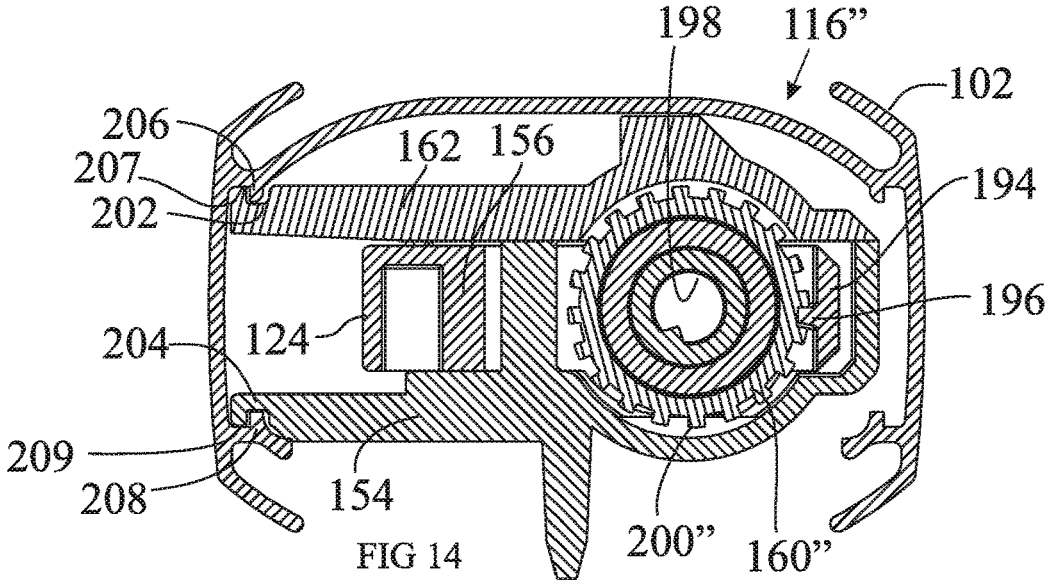
FIG. 14 is a section view, similar to FIG. 12, but for a different embodiment showing a one-way bearing brake mechanism.

FIG. 14 shows another alternate embodiment of a brake 116" wherein the splined sleeve 160 is replaced with a one-way bearing mechanism 160". The one-way bearing mechanism 160" has the same splines 200" as in the splined sleeve 160. However, the one-way bearing mechanism 160" incorporates a one-way bearing between the splines 200" and the bore 198, which allows the free rotation of the inner race of the bearing in a first direction but locks the inner race to the outer race of the bearing when driven in the opposite, second direction. To allow rotation of the one-way bearing mechanism 160" in the second direction, the user must disengage the ridge 196 from the outer race by pressing down on the button 120 of the handle 118 as in the previous embodiments.

As was the case for the previous embodiment 116', this brake 116" is used advantageously so that disengagement of the brake 116" is only needed for lowering the shade 104 (See FIG. 1). The shade 104 may be raised by simply pushing up on the rail 102, without first having to release the brake 116".

As may be readily envisioned, the brake 116 may have other modifications as well. For instance, the splined sleeve 160 may be replaced by a smooth, non-splined cylinder, and the rear wall 194 of the slide element 156 and its corresponding ridge 196 may be replaced by a semicircular brake pad. The brake pad would be pressed against the cylinder by the biasing action of the spring to stop the rotation of the cylinder (and the rotation of the rod to which the cylinder is keyed). Pressing on the contact plate of the brake against the biasing force of the spring moves the brake pad away from the cylinder, allowing the cylinder and the lift rod to rotate in either direction.

Referring now to FIGS. 3-6 and 15, the handle 118 includes a button 120, which the user depresses to disengage the brake 116. The handle 118 defines a front-to-back directed, "U"-shaped cross-section channel 150 (See FIG. 4) which slidingly receives a pusher in the form of an actuator shaft 122. The actuator shaft 122 is an elongated member having a substantially rectangular cross-section and defines a blunt distal end 142, which pushes against the contact plate 124 of the brake 116 to disengage the brake 116. The actuator shaft 122 also defines a sloped or ramped proximal end 144.

Figure 15:
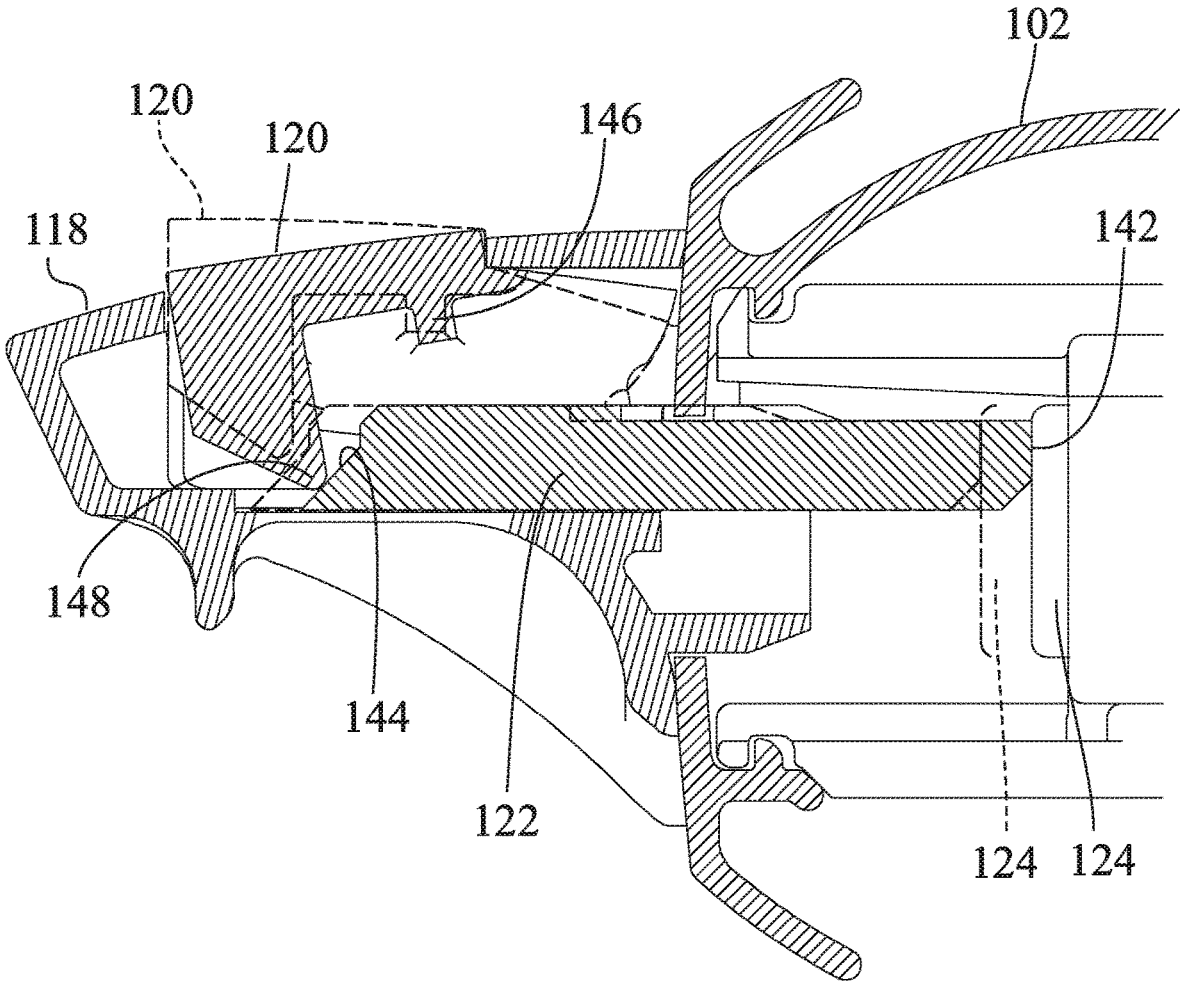
FIG. 15 is an enlarged, broken-away view of the handle, actuator button, and pusher portion of FIG. 6, with the actuator button, pusher, and contact plate shown also in phantom when the button is not depressed by the user.
Figure 18:
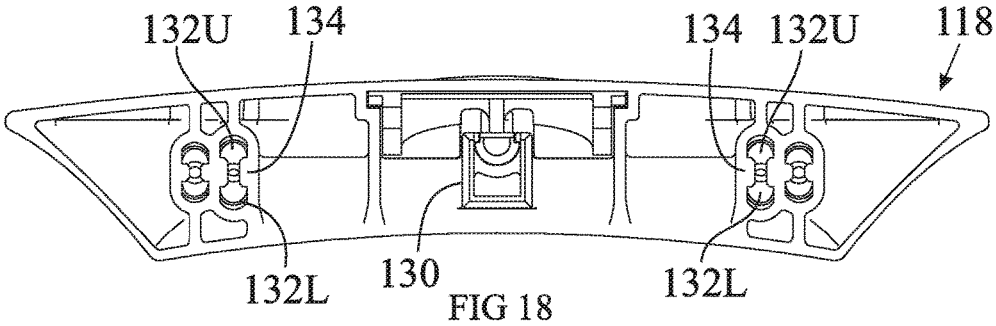
FIG. 18 is a rear view of the handle of FIG. 16.

The actuator button 120 is received in an opening 152 in the handle 118. (See FIGS. 3 and 4). The actuator button 120 includes leftwardly-and-rightwardly-extending stub shafts 146, which are received in recesses 146A on the handle to pivotably support the actuator button 120 on the handle 118. A finger 148 extends downwardly on the front portion of the button 120, forward of the stub shafts 146. As shown in FIG. 15, as the actuator button 120 is depressed (from the dotted phantom position to the solid position) by the user, the actuator button 120 pivots about its stub shafts 146 such that the finger 148 travels along an arcuate path, moving downwardly and rearwardly.

The finger 148 on the actuator button 120 abuts the ramped proximal end 144 of the actuator shaft 122. As the finger 148 moves downwardly and rearwardly, it pushes against the ramped proximal end 144 of the actuator shaft 122, which displaces the actuator shaft 122 rearwardly so the blunt distal end 142 pushes the contact plate 124 of the brake 116 rearwardly to disengage the brake 116.

In addition, as the finger 148 pushes rearwardly on the ramped proximal end 144 of the actuator shaft 122, it also moves downwardly along the ramped surface 144 of the actuator shaft 122. As a result, as the finger 148 pushes downwardly, it also pushes on a progressively more forwardly portion of the ramp on the ramped proximal end 144 of the actuator shaft 122. This results in an effective rearward motion of the actuator shaft 122 which is considerably larger than the downward motion of the actuator button 120. In one embodiment, the effective rearward motion of the actuator shaft 122 is at least twice the downward motion of the actuator button 120.

FIG. 5 shows the actuator button 120, the actuator shaft 122, and the contact plate 124 in the normal, braked position. FIG. 6 shows the actuator button 120 depressed, the actuator shaft 122 pushed rearwardly, and the contact plate 124 pushed rearwardly to disengage the brake 116.

As shown in FIGS. 7-9, the length dimension of the contact plate (the dimension extending parallel to the axial length of the rail 102 and parallel to the axis of the rod 112 (See FIG. 2)) is substantially longer than the corresponding length dimension (the dimension extending parallel to the axial length of the rail 102 and of the rod 112) of the distal end 142 of the actuator shaft 122. This provides substantial leeway in the positioning of the brake 116 along the axial length of the lift rod 112 while still allowing the distal end 142 of the actuator shaft 122 to abut the contact plate 124 of the brake 116 in order to release the brake 116.

Since there is no direct mechanical link between the handle 118 and the brake 116, with the only requirement being that the actuator shaft 122 of the handle 118 abut some point on the contact plate 124 of the brake 116, the handle 118 can be installed onto the rail 102 at any time during the assembly process of the shade 104. This allows the installation of the handle 118 when the rail 102 is still empty, which allows the use of fasteners extending from the inside of the rail 102 into the handle 118. In this particular embodiment, screws 138 are used. Since the screws 138 (See FIGS. 16 and 17) are installed from inside the rail 102 and into the handle 118, they are hidden upon installation, and additional time and resources are not needed to hide these fasteners.

Mounting the Handle on the Rail

Figure 17:
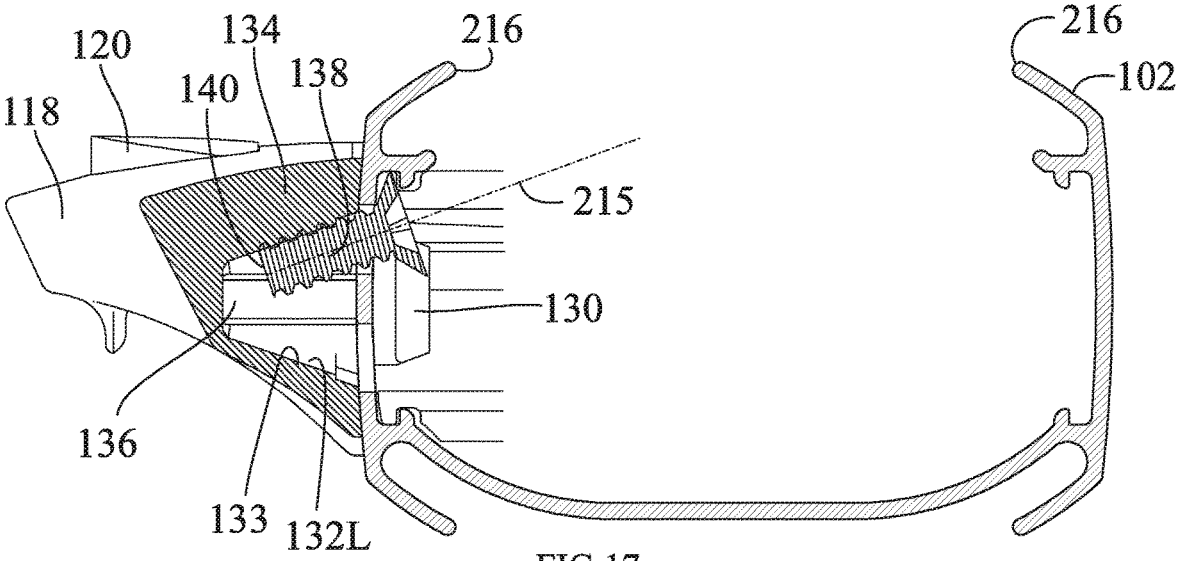
FIG. 17 is a section view, similar to FIG. 16, but for an application wherein the handle is attached to a fixed top rail instead of to a bottom or movable rail.
Figure 19:
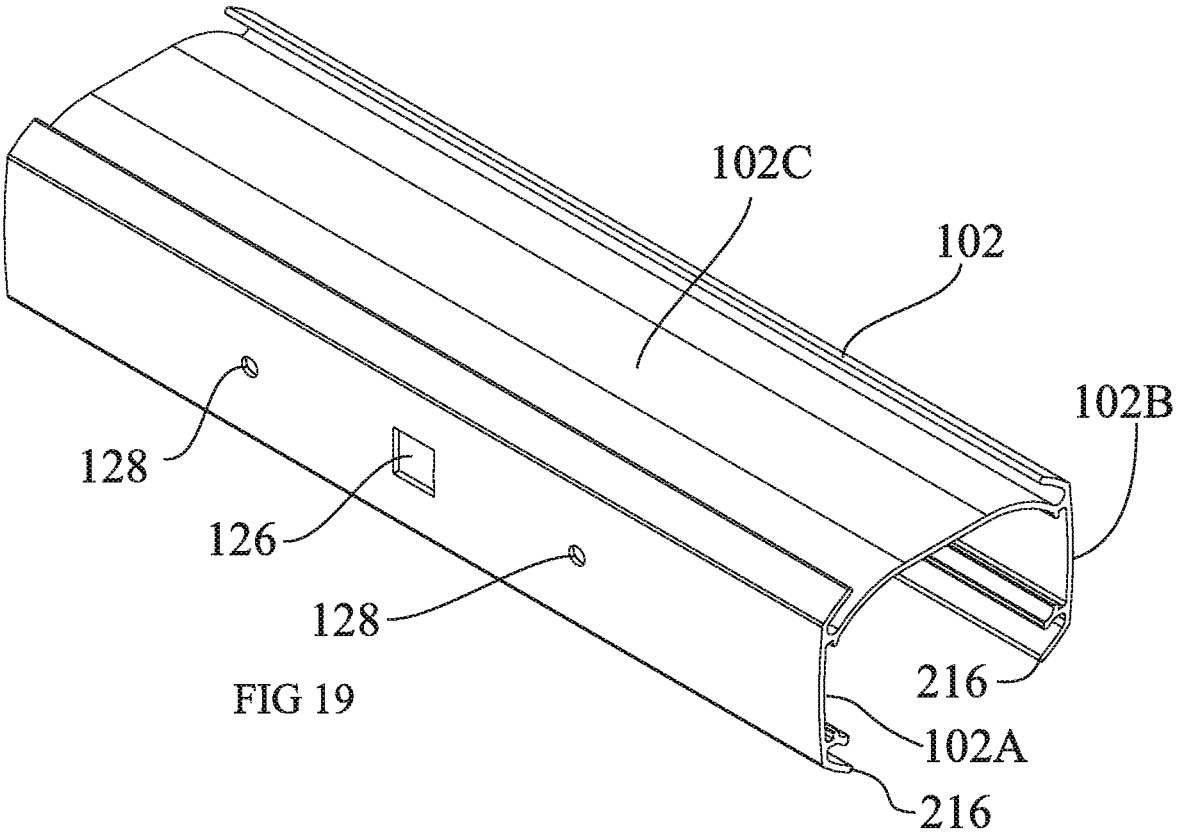
FIG. 19 is a perspective view of a portion of the rail of FIG. 7 showing the openings for mounting the handle.
Figure 20:
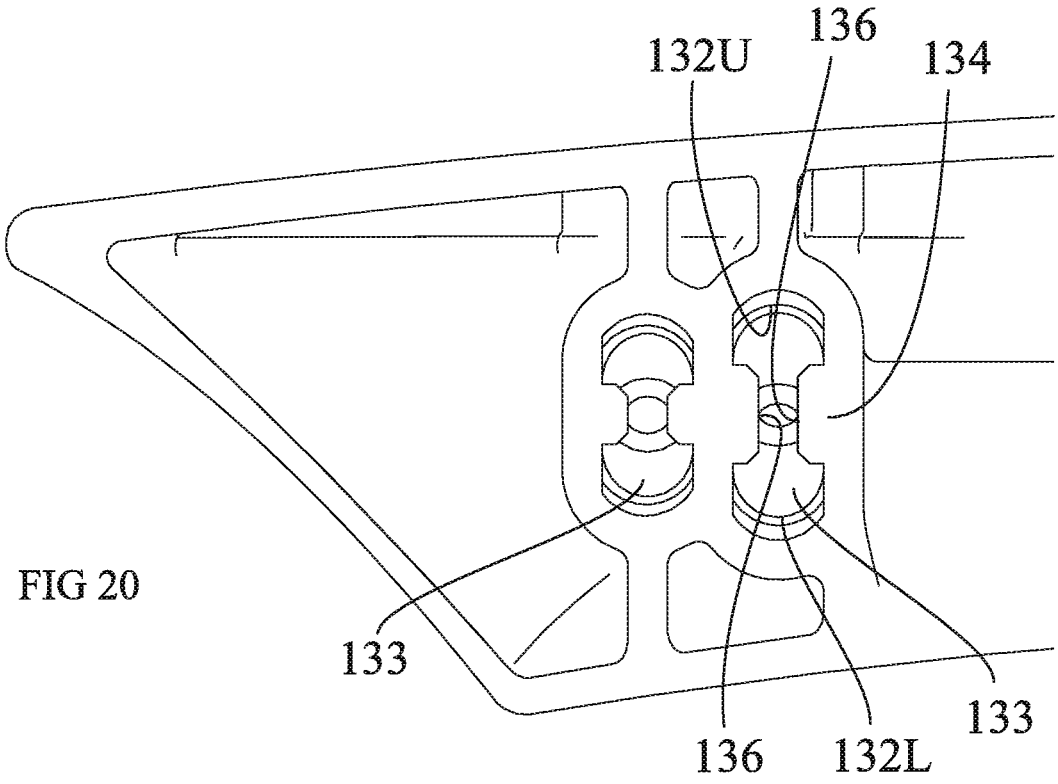
FIG. 20 is an enlarged, broken-away view of the handle of FIG. 18.

As shown in FIG. 19, the rail 102 has a U-shaped cross-section, with a front wall 102A and a rear wall 102B merging with a connecting wall 102C. Each of the front and rear walls 102A, 102B has a free edge 216. The front wall 102A defines a rectangular through-opening 126 centrally located on the rail 102 between two circular through-openings 128. As shown in FIG. 17, a rectangular cross-section shoulder 130 projects rearwardly from the rear surface of the handle 118 and extends through the rectangular opening 126 of the rail 102 to locate the handle 118 on the rail 102 and to align the handle 118 with the rail 102 for assembly. This rectangular cross-section shoulder 130 is an extension of the body that forms the U-shaped channel 150 that receives and guides the actuator shaft 122, as can be seen in FIGS. 5 and 6. The rear surface of the handle 118 abuts the front surface 102A of the rail 102.

Angled, runnerless screw cavities in the handle 118 allow for easy and secure insertion of the screws 138 without requiring a complicated mold for casting the handle 118, as explained below.

Referring to FIGS. 16-20, the handle 118 includes two bosses 134, with each boss defining a pair of upper and lower skewed openings 132U, 132L respectively. Each of the openings 132U, 132L is defined by an angled guide surface 133 and a slotted wall 136, which provides a slotted yielding surface. The slotted wall 136 is a wall that extends into the handle 118 the length of the openings 132U, 132L (as best appreciated in FIGS. 16 and 17).

Figure 16:
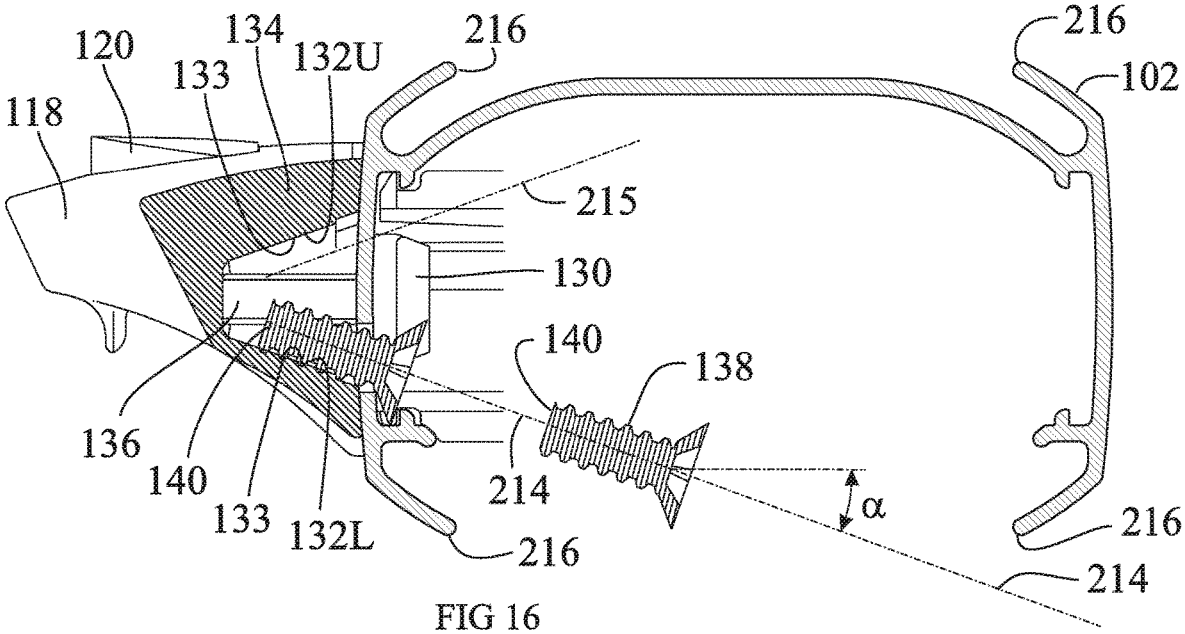
FIG. 16 is a section view along line 16-16 of FIG. 2, with the brake portion partially broken away for clarity.

The guide surfaces 133 have a partial-cylindrical cross-sectional shape and are elongated in the front-to-back direction. As shown in FIG. 16, each of the guide surfaces 133 of the lower openings 132L defines an axis 214, and each of the guide surfaces 133 of the upper openings 132U defines an axis 215. Due to their skewed nature, the axes 214, 215 converge toward each other inside the handle 118. Each of these axes 214, 215 defines the axis of a screw 138 that is threaded into the respective opening 132U or 132L. (FIG. 17 shows an arrangement in which the rail 102 is inverted, so the screws are threaded into the upper openings 132U.) The slotted wall 136 and the slotted yielding surface defined by that wall 136 are farther from the first screw axis at the rear opening and taper toward the screw axis as the slotted yielding surface extends toward the front of the handle.

This arrangement of openings 132U, 132L with an intermediate slotted wall 136 may be accomplished with a simple mold that does not require special inserts and yet allows for the skewed threading of fasteners onto the handle 118.

Referring to FIG. 16, it may be appreciated that the axis 214 lies at an angle α relative to a horizontal plane extending in the front-to-back direction. This angle is referred to as the approach angle. Since the axis 214 clears the free rear edge 216 of the rail 102, it allows a screw 138 to be inserted using a conventional tool, such as a conventional Philips screwdriver (not shown), with the handle of the screwdriver being located outside the rail 102 and the shaft of the screwdriver extending along the axis 214 into the rail 102. (The shaft of the screwdriver would extend along the axis 215 in the arrangement of FIG. 17.)

As the fastener 138 is threaded into the opening 132L, the ramped guide surface 133 pushes the end 140 of the fastener 138 into the slotted wall 136, so the screw grips tightly into the handle 118 in an otherwise unthreaded (runnerless) opening 132.

Assembly:

Referring to FIG. 11, to assemble the brake portion 116, the front end 184 of the coil spring 158 is placed inside the cavity 186 of the slide element 156 lying just inside the contact plate 124. The slide element 156 then is slid into the housing 154, with the contact plate 124 projecting through the front opening 168. The back end 182 of the coil spring 158 then is slid over the internal projection 180 on the housing base 154 so as to capture the coil spring 158, with the coil spring 158 biasing the slide element 156 in the forward, braked position. The splined sleeve 160 is dropped in between the recessed arms 210, 212 of the slide element 156 such that the stub shafts 201 of the splined sleeve 160 are rotationally supported on the "U"-shaped openings 176, 178 of the housing base 154 and the ridge 196 is received between two of the splines 200. Finally, the housing cover 162 is snapped onto the housing base 54.

The assembled brake 116 is then mounted into the rail 102 (See FIG. 12) by sliding it in from one of the ends of the rail 102, making sure that the upper and lower channels 202, 204 of the brake portion 116 are engaged with the lips 206, 208 of the rail 102. The brake 116 is slid axially along the rail 102 (See FIG. 2) until at least a portion of the contact plate 124 of the brake portion 116 is in alignment with the blunt distal end 142 of the actuator arm 122 of the handle 118 (See FIGS. 7-9). Finally the lift rod 112 is inserted through the hollow through shaft 198 of the splined sleeve 160 and the remaining elements, such as the lift stations 110 and the spring motor 114 are mounted onto the lift rod 112.

It should be noted that, as the contact plate 124 is pushed rearwardly (transverse to the axis of rotation of the rod 112 and against the biasing force of the coil spring 158), the entire slide element 156 slides rearwardly, moving the ridge 196 on the rear wall 194 of the slide element 156 away from the splines 200 of the splined sleeve 160. This unlocks the splined sleeve 160 so it may rotate in either clockwise or counterclockwise directions (See also FIG. 12). Of course, as the user grabs the handle 118 he naturally presses down on the button 120 (See FIG. 15) which pushes the actuator arm 112 rearwardly to push back against the contact plate 124 of the brake portion 116, releasing the brake, unlocking the splined sleeve 160 (and the lift rod 112 which rotates with the splined sleeve 160) for rotation in clockwise or counterclockwise directions.

While a specific handle 118 has been shown here, it is understood that various types of handles could be used to actuate the braking arrangements that are shown, including a handle that is molded into the rail, or even no handle at all, as long as there is some way to move the actuator shaft 122 (or some other type of pusher), The actuator shaft or pusher could be moved manually by a button or lever that is not associated with a handle or by an electrically-operated actuator or some other actuator mounted on the rail.

It will be obvious to those skilled in the art that modifications may be made to the embodiments described above without departing from the scope of the present invention as claimed.

What is claimed is:

1. A brake arrangement for a covering for an architectural opening, the arrangement comprising:
- a hollow rail;
- a rod extending within said hollow rail and being rotatable about an axis of rotation;
- a brake provided for movement into and out of engagement with said rod to prevent or allow rotation of said rod about said axis of rotation, respectively;
- a button assembly provided in operative association with said hollow rail, said button assembly comprising:
  - a button housing coupled to said hollow rail;
  - an actuator button supported by said button housing for movement relative to said button housing; and
  - a pusher rod provided in operative association with said actuator button, said pusher rod extending between a first end proximal to said actuator button and a second end distal to said actuator button;
- wherein said second end of said pusher rod comprises a free end of said pusher rod configured to abut against a portion of said brake to disengage said brake from said rod with actuation of said actuator button.

2. The brake arrangement of claim 1, wherein:
- said pusher rod extends in a lengthwise direction between said first end of said pusher rod and said second end of said pusher rod; and
- said pusher rod is configured to engage said portion of said brake in the lengthwise direction.

3. The brake arrangement of claim 2, wherein:
- said portion of said brake comprises a movable portion of said brake; and
- said pusher rod is configured to actuate said movable portion of said brake in the lengthwise direction to disengage said brake from said rod with actuation of said actuator button.

4. The brake arrangement of claim 1, wherein:
- said first end of said pusher rod comprises a free end of said pusher rod; and
- a portion of said actuator button is configured to press against said first end of said pusher rod with actuation of said actuator button relative to said button housing.

5. The brake arrangement of claim 1, wherein said button housing comprises a handle configured to be grasped by a user of the brake arrangement when moving the covering relative to the architectural opening.

6. The brake arrangement of claim 1, wherein said actuator button is supported along a top side of said button housing such that said actuator button is configured to be actuated downwardly relative to said button housing.

7. The brake arrangement of claim 6, wherein:

said first end of said pusher rod defines a ramped profile; and downward movement of said actuator button relative to said button housing moves a portion of said actuator button against said ramped profile of said first end of said pusher rod to move said pusher rod towards said portion of said brake.

8. The brake arrangement of claim 1, wherein:

said button housing is coupled to said hollow rail by a fastener; and said button housing conceals the fastener from view from an exterior front face of said hollow rail along which said button housing extends.

9. The brake arrangement of claim 1, wherein said actuator button is supported by said button housing for pivotable movement relative to said button housing.

10. The brake arrangement of claim 9, wherein said actuator button is configured to move along an arcuate path relative to said button housing towards said hollow rail with actuation of said actuator button.

11. The brake arrangement of claim 1, wherein:

said hollow rail includes a wall defining an exterior face along which said button housing is coupled to said hollow rail; and said pusher rod extends through said wall such that said first end of said pusher rod is located along an exterior of said hollow rail and said second end of said pusher rod is located within an interior of said hollow rail.

12. A brake arrangement for a covering for an architectural opening, the arrangement comprising:

a hollow rail defining an exterior front face;

a rod extending within said hollow rail and being rotatable about an axis of rotation;

a brake provided for movement into and out of engagement with said rod to prevent or allow rotation of said rod about said axis of rotation, respectively; and a button assembly provided in operative association with said hollow rail, said button assembly comprising:

a button housing coupled to said hollow rail along said exterior front face of said hollow rail; and an actuator button supported by said button housing for pivotable movement relative to said button housing;

wherein, when said actuator button is moved relative to said button housing, said brake is actuated relative to said rod to disengage said brake from said rod.

13. The brake arrangement of claim 12, wherein said actuator button is configured to move along an arcuate path relative to said button housing towards said hollow rail with actuation of said actuator button.

14. The brake arrangement of claim 12, wherein said button housing comprises a handle configured to be grasped by a user of the brake arrangement when moving the covering relative to the architectural opening.

15. The brake arrangement of claim 12, wherein said actuator button is supported along a top side of said button housing such that said actuator button configured to be pivoted downwardly relative to said button housing.

16. The brake arrangement of claim 12, further comprising a pusher rod provided in operative association with said actuator button and extending at least partially within said hollow rail, said pusher rod being configured to actuate said brake relative to said rod with movement of said actuator button relative to said button housing.

17. The brake arrangement of claim 16, wherein:

said pusher rod extends between a first end proximal to said actuator button and a second end distal to said actuator button; and said second end of said pusher rod comprises a free end of said pusher rod configured to abut against a portion of said brake to disengage said brake from said rod with movement of said actuator button relative to said button housing.

18. The brake arrangement of claim 17, wherein:

said first end of said pusher rod defines a ramped profile; and pivotable movement of said actuator button relative to said button housing moves a portion of said actuator button against said ramped profile of said first end of said pusher rod to move said pusher rod towards said portion of said brake.

19. The brake arrangement of claim 17, wherein:

said first end of said pusher rod comprises another free end of said pusher rod; and a portion of said actuator button is configured to press against said first end of said pusher rod with actuation of said actuator button relative to said button housing.

20. The brake arrangement of claim 17, wherein:

said hollow rail includes a wall defining said exterior front face of said hollow rail; and said pusher rod extends through said wall such that said first end of said pusher rod is located along an exterior of said hollow rail and said second end of said pusher rod is located within an interior of said hollow rail.

* * * * *